US011514774B2

(12) United States Patent
Barnes et al.

(10) Patent No.: US 11,514,774 B2
(45) Date of Patent: Nov. 29, 2022

(54) AUDIBLE ALERT DEVICE

(71) Applicant: Brady Worldwide, Inc., Milwaukee, WI (US)

(72) Inventors: Edward Barnes, Sale (GB); Adrian Priestley, Hyde (GB); Paul Ingleby, Southam (GB)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 17/424,342

(22) PCT Filed: Jan. 21, 2020

(86) PCT No.: PCT/US2020/014454
§ 371 (c)(1),
(2) Date: Jul. 20, 2021

(87) PCT Pub. No.: WO2020/154311
PCT Pub. Date: Jul. 30, 2020

(65) Prior Publication Data

US 2022/0114877 A1 Apr. 14, 2022

Related U.S. Application Data

(60) Provisional application No. 62/795,246, filed on Jan. 22, 2019.

(51) Int. Cl.
*G08B 21/24* (2006.01)
*G08B 5/36* (2006.01)

(52) U.S. Cl.
CPC ..... *G08B 21/24* (2013.01); *G08B 5/36* (2013.01)

(58) Field of Classification Search
CPC ..... G08B 21/24; G08B 5/36
See application file for complete search history.

(56) References Cited

U.S. PATENT DOCUMENTS 4,827,264 A * 5/1989 Bjelk ..... G01S 13/56 342/61
9,110,450 B2 * 8/2015 Alberth, Jr. ..... G06F 21/32
9,781,809 B2 * 10/2017 Herman ..... H05B 45/10
2015/0022344 A1 1/2015 Matsuoka et al.
(Continued)

FOREIGN PATENT DOCUMENTS

CN 108550231 A 9/2018
GB 2395337 A 5/2004
(Continued)

OTHER PUBLICATIONS

PCT International Search Report and Written Opinion, PCT/US2020/014454, dated Apr. 6, 2020, 13 pages.
(Continued)

*Primary Examiner* — John A Tweel, Jr.
(74) *Attorney, Agent, or Firm* — Quarles & Brady LLP

(57) ABSTRACT

An audible alert device and method of playing an audible message. The audible alert device includes a motion sensor, a speaker, and a control unit. The control unit is configured to store an audible message, determine whether an activating condition is met in which the activating condition is based on a directionality of movement of the person relative to the motion sensor, and play a corresponding audible message when the activating condition has been met.

21 Claims, 6 Drawing Sheets

(56) References Cited

U.S. PATENT DOCUMENTS

| | | | | |
|---|---|---|---|---|
| 2016/0227046 | A1 | 8/2016 | Shuster | |
| 2018/0075712 | A1 | 3/2018 | Field | |
| 2018/0189946 | A1 | 7/2018 | Kusens et al. | |
| 2018/0293221 | A1 | 10/2018 | Finkelstein et al. | |
| 2019/0005801 | A1 | 1/2019 | Hermann et al. | |
| 2021/0174660 | A1* | 6/2021 | Kamimura | G08B 21/02 |

FOREIGN PATENT DOCUMENTS

| | | | |
|---|---|---|---|
| GB | 2406691 | A | 4/2005 |
| WO | 2009030912 | A1 | 3/2009 |

OTHER PUBLICATIONS

European Patent Office, Partial Supplementary Search Report, Application No. 20744685.7, dated Sep. 16, 2022, 20 pages.

* cited by examiner

AUDIBLE ALERT DEVICE

CROSS-REFERENCE TO RELATED APPLICATION

This application represents the U.S. national stage entry of International Application No. PCT/US2020/014454 filed Jan. 21, 2020, which claims the benefit of U.S. Provisional Application No. 62/795,246 entitled "Audible Alert Device" filed on Jan. 22, 2019, which is hereby incorporated by reference for all purposes as if set forth in its entirety herein.

FIELD OF INVENTION

This disclosure relates to an audible alert device with directional motion sensing.

BACKGROUND

In a variety of applications, motion sensors are used to detect movement and then play a sound. In particular, passive infrared sensors are generally known in the art for detecting the movement of people. This technology can apply in workplace receptions, to toys and other props, and to security applications among many others. Devices with motion sensors and a speaker can be situated in the vicinity of locations where people generally pass by, and the device will play a sound or message when the device detects any movement in the vicinity.

SUMMARY

In most applications, motion-detecting devices are unsophisticated and are designed to play a noise or message when the sensor detects any movement. While such simple devices that play a sound after detecting any movement from a passerby are useful in a variety of circumstances, there is a need for a more sophisticated system for providing audible alerts.

Disclosed herein are improved audible alert devices that detect directionality of movement relative to the sensor in at least some of the operational modes. In response to a particular type of detected directional movement relative to the sensor, an appropriate and corresponding sound may then be played in response to the activating condition. For example, the types of movements can be "toward" meaning the distance between the moving object and the motion sensor is decreasing, or "away" meaning the distance between the moving object and the motion sensor is increasing. Further, the sound or message that is played by the device can be associated with, and relevant to, the type of movement detected. In some instances, there may be multiple messages associated with a particular activating condition so as to help catch the attention of the person.

The ability to differentiate between different directions of movement detected by a motion sensor is useful where an audible message is only applicable to a passerby moving in a particular direction with respect to the motion sensor. For example, in applications where a safety signage is frequently ignored or missed, a motion detection device that ensures attention grabbing auditory messages are delivered at relevant times (for example, entry or exit from a location of increased hazard or danger) that would help with safety compliance.

Disclosed herein is an audible alert device that allows for, among other things, a device that detects motion with a motion sensor and allows for the pre-programming or user selection of an activating condition, based on the direction of motion sensed, that triggers an audible message to play.

According to one aspect, an audible alert device is provided. The audible alert device comprises a motion sensor configured to detect movement of a person, a speaker, and a control unit in communication with the motion sensor and the speaker. The control unit is configured to store an audible message, to determine whether an activating condition is met in which the activating condition relates to a direction of movement of the person with respect to the motion sensor, and to play the audible message corresponding to the activating condition when the activating condition is met.

In some forms, the motion sensor may be an infrared motion sensor. However, other types of sensors might be implemented to similar effect. The motion sensor may comprise at least two sensors (i.e. includes two separate components which together define the motion sensor and provide its functionality).

In some forms, the motion sensor may comprise an infrared motion sensor, and at least one of the following sensors: an ultrasonic sensor, a LiDAR sensor, a laser rangefinder, a radar sensor, and a camera configured to provide images usable by the control unit to determine presence or motion of the person.

In some forms, the activating condition may be the detection of movement toward the motion sensor in which a distance of the person to the motion sensor is decreasing over time and/or may be the detection of movement away from the motion sensor in which a distance of the person to the motion sensor is increasing over time.

In some forms, the control unit may store multiple audible messages. For example, a first audible message may be played when the motion sensor detects movement toward the motion sensor and the second audible message can be played when the motion sensor detects movement away from the motion sensor.

In some forms, the audible alert device may further include a user interface in communication with the control unit. The user interface can be configured to allow a user to select an operation mode from a set of operation modes in which the set of operation modes includes two or more operational modes: (1) an any-direction mode in which, when the motion sensor detects movement of a person toward the motion sensor in which a distance of the person to the motion sensor is decreasing over time or away from the motion sensor in which a distance of the person to the motion sensor is increasing over time, the control unit plays an audible message that is not associated with a detected direction of movement; (2) an only-toward mode in which, when the motion sensor detects movement toward the motion sensor in which a distance of the person to the motion sensor is decreasing over time, the control unit plays an audible message associated with movement toward the motion sensor; (3) an only-away mode in which, when the motion sensor detects movement away from the motion sensor in which a distance of the person to the motion sensor is increasing over time, the control unit plays an audible message associated with movement away from the motion sensor; and (4) a direction-based mode in which, when the motion sensor detects movement toward the motion sensor in which a distance of the person to the motion sensor is decreasing over time, the control unit plays an audible message associated with movement toward the motion sensor and, when the motion sensor detects movement away from the motion sensor in which a distance of the person to the motion sensor is increasing over time, the control unit plays a different audible message associated with movement away from the motion sensor.

In some forms, the audible alert device may also include a light emitting element and the light emitting element may be illuminated when the audible alert device plays the audible message.

In some forms, the control unit may further be configured to randomly select the audible message to be played from a plurality of audible messages. Such "random" message can still be related to the particular activating condition, and may be just one of a group of unique messages to better catch the attention of the person instead of a single repeating message associated with the activating condition.

According to one aspect, an alert device is provided, comprising a motion sensor configured to detect movement of a person, a display module, and a control unit. The control unit is in communication with the motion sensor and the display module and may be configured to store a visual message, determine whether an activating condition is met, the activating condition relating to the direction of movement of the person with respect to the motion sensor, and display the visual message corresponding to the activating condition when the activating condition is met.

In some forms, such an alert device that selectively provides a visual message as described in the paragraph above can incorporate any and all of the aforementioned and hereinafter features either alone or in combination with one another in a manner analogous to that described with respect to the audible alert device. However, instead of those features being directed toward one or more audible messages, the features can be applied to the one or more visual messages.

According to another aspect, a method of playing an audible message is provided. A direction of movement of a person is detected with a motion sensor of an audible alert device in which the audible alert device includes a speaker and a control unit that is in communication with the motion sensor and the speaker. Whether the activating condition has been met is determined based on the detected direction of movement by the motion sensor. When the activating condition is met, an audible message is played corresponding to the activating condition.

In some forms, the method further includes implementing an operation mode from a set of operation modes based on a user selection. As noted above, these may include an any-direction mode, an only-direction mode, and/or a direction-based mode as described above and elsewhere herein.

Again, in some forms, the motion sensor can comprise at least two sensors and may include an infrared motion sensor.

In some forms, the detection of movement of the person by the motion sensor may include activating condition(s) in which movement toward the motion sensor is detected in which a distance of the person to the motion sensor is decreasing over time and/or in which movement away from the motion sensor is detected in which a distance of the person to the motion sensor is increasing over time.

In some forms, the method may further include receiving an audible message, which may be recorded by a user.

In some forms, when the control unit stores multiple audible messages including a first audible message and a second audible message, the method may further involve (1) playing the first audible message when the motion sensor detects movement toward the motion sensor in which a distance of a person to the motion sensor is decreasing over time and (2) playing the second audible message when the motion sensor detects movement away from the motion sensor in which a distance of the person to the motion sensor is increasing over time.

In some forms, the method may further include randomly selecting the audible message corresponding to the activating condition.

In some forms, the audible alert device may also include a light emitting element and the method may further include illuminating the light emitting element when the audible alert device plays the audible message.

In some forms, the method may further include ignoring the activating condition for a set period of time after the activating condition is met. This may effectively provide a "reset delay" after an activation condition is met before an activating condition may be detected again.

According to yet another aspect, a safety alert system is provided having the audible alert device described above and herein along with a visual display in close proximity to the audible alert device corresponding to the at least one audible message.

According to yet another aspect a safety alert system is provided having an audible alert device. The audible alert device includes: a motion sensor configured to detect movement of a person; a speaker; and a control unit in communication with the motion sensor and the speaker. The control unit is configured to: store an audible message; determine whether an activating condition is met, the activating condition relating to a direction of movement of the person with respect to the motion sensor; and play the audible message corresponding to the activating condition when the activating condition is met. The safety alert system is also provided with an illuminable visual display in close proximity to the audible alert device corresponding to the audible message. The visual display is configured to be illuminated when the audible message is played.

In some forms, the illuminable visual display comprises a sign and an illuminating device configured to illuminate the sign when the audible message is played.

In some forms, the control unit is configurable by a user to operate in a display-only mode wherein the control unit is configured to illuminate the visual display and not play the audible message when the activating condition is met and to operate in an audio-only mode wherein the control unit is configured to play the audible message and not illuminate the visual display when the activating condition is met. Thus, it is contemplated that the device can have settings that provide only audio feedback, only visible feedback, or both audio and visible feedback together.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 2:
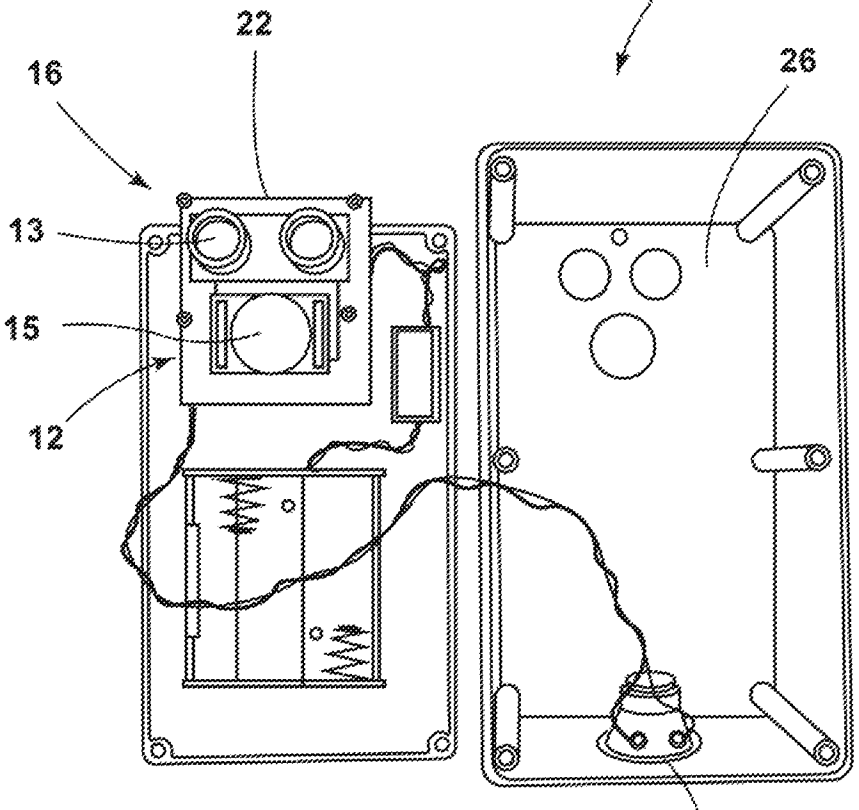
FIG. 2 is a disassembled view of the audible alert device of FIG. 1.
Figure 1:
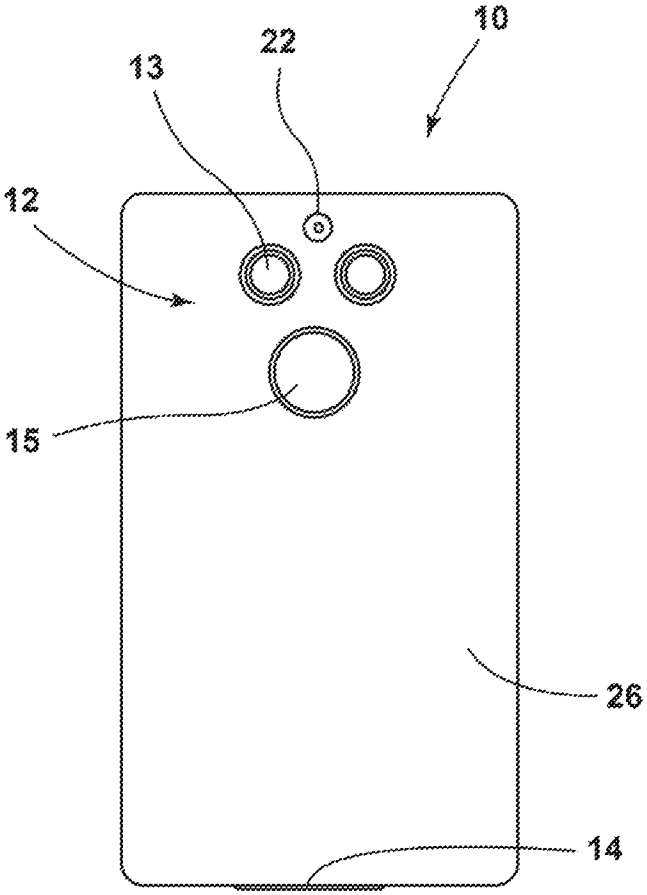
FIG. 1 is a view of an audible alert device.

Referring to FIGS. 1 and 2, an audible alert device 10 is illustrated. Generally speaking, the audible alert device 10 includes a motion sensor 12, a speaker 14, a control unit 16, a user interface (not shown), a lighting element 22, and a housing 26. One having ordinary skill in the art will readily understand that the electrical elements/components on the printed circuit board and the housing may be redesigned to achieve a particular form factor or aesthetic appearance. The motion sensor 12 and speaker 14 are in communication with the control unit 16, and the user interface is also in communication, electrical or otherwise, with the control unit 16. As used herein, when two or more items are in "communication" with one another this is intended to cover all known forms of communication including, but not limited to, electrical communication, optical communication, wireless communication, magnetic communication and so forth. Thus, while a particular form factor and physical connectivity is shown in the example embodiment, this is to be understood as but one possible configuration of the device.

The motion sensor 12 is configured to detect directional movement of a person. Motion sensor 12 can comprise one or more sensors (i.e. includes two separate components which together define the motion sensor and provide its functionality). For example, infrared sensing technology or any other sensor capable of delivering an electrical response or signal to the control unit 16 based on movement detected can be implemented to sense general movement within the range of the motion sensor 12. An ultra-sonic sensor, LiDAR detection technology, a laser distance sensor, camera, or other sensor capable of delivering an electrical response or signal to the control unit 16 can be used to detect the distance of the person from the motion sensor 12. The motion sensor 12 can thereby be comprised of a single sensor with a single sensing technology, multiple sensors with a single sensing technology, or multiple sensors with multiple sensing technologies. In the embodiment shown in FIGS. 1 and 2, for example, the motion sensor 12 is comprised of an infrared sensor 15 and an ultra-sonic sensor 13 that work in conjunction to detect the directional movement and proximity of a person.

The control unit 16 is configured to store at least one audible message for selectively being played on the speaker 14, to determine if an activating condition is met based on the signals from the motion sensor 12 and other established activating conditions, and play the audible message corresponding to the activating condition when the activating condition has been met.

The audible messages may take a number of different forms such as, for example, a recorded communication in a language understood by a person, noises, alarms, or any other relevant sound for a particular audible alert application. Still yet, the messages may include multiple messages associated with a single activating condition. For example, the messages may include the same message recorded in various different languages. Still further, the audible messages associated with an activating condition may include various different messages conveying the same idea in different unique ways (e.g., "Put on hard hat", "Hard hats required in this area", and "Please ensure hard hat is worn in this area") which may be randomly played based on the activating condition being met.

The activating condition or activating conditions as well as the corresponding audible messages can be selected by the user before or after installation and/or, in some forms, the activating condition(s) and/or message may be pre-programmed into or stored in the audible alert device 10 such that no user interaction is required.

It is contemplated that one or more of the activating condition(s) involve determining the direction of movement of the person relative to the motion sensor 12. For example, the activating condition may be the detection of movement toward the motion sensor 12, away from the motion sensor 12, or the detection of movement uniquely and specifically in either the toward or away direction. When the control unit 16 determines that the activating condition has been met, the control unit 16 can play a single audible message or multiple audible messages associated with the detected activating condition.

Multiple activating conditions can be preprogrammed to the control unit 16 or selected by the user, and multiple audible messages can be stored in the control unit 16 so that the control unit 16 plays different audible messages corresponding to different activating conditions. For example, the control unit 16 can determine if movement away from the motion sensor 12 has been detected and play a message related to movement away from the sensor, and then when the control unit 16 determines that the motion sensor 12 has detected movement toward the motion sensor 12, the control unit 16 can play a different message corresponding to the movement toward the motion sensor 12.

Again, when multiple audible messages have been stored in the control unit 16, the control unit 16 can also randomly select the audible message to be played from a group of audible messages associated with the activating condition determined by the control unit 16. For example, if the activating condition is the detection of movement only toward the motion sensor 12, the control unit 16 can randomly select an audible message to be played from a group of "detecting movement toward" messages when the control unit 16 determines that the motion sensor 12 has detected movement toward the motion sensor 12. In this configuration, the control unit 16 will not play any message when either no movement is detected or when movement is detected away from the motion sensor 12.

Further, the ability to randomly select an audible message can be applied to when the control unit 16 is programmed for multiple activating conditions. To illustrate, the control unit 16 can randomly select the audible message from a group of "detecting movement away" messages when movement away from the sensor 12 is detected and can randomly select the audible message from a group of "detecting movement toward" messages when movement toward the sensor 12 is detected. While some messages may be unique for each group, they are also generally conveying the same substantive content.

The random selection of audible messages by the control unit helps the audible message stay fresh to users in the audible alert device's intended application. For example, if the audible alert device is used to remind a passerby to abide by important safety protocols when entering a dangerous area of the workplace, the passerby is less likely to ignore the message if the message is randomly selected from a group of multiple messages rather than being the same message upon each entrance.

The activating condition settings, as described above, may be selected by the user via a user interface—which can be a mechanical control system comprised of buttons, switches, or other mechanical control mechanisms that are in communication with the control unit 16 (examples of such mechanical interface elements will be described below in connection to FIG. 7), but can also be other controls whether part of the device 10 or apart from the device and be connected to the control unit 16 wirelessly via WiFi or Bluetooth, for example. The user can select an operation mode from a set of operation modes. These operation modes can include two or more of an any-direction mode, an only-toward mode, an only-away mode, and/or a direction-based mode. In the any-direction mode, when the motion sensor 12 detects movement toward the motion sensor 12 in which a distance of the person to the motion sensor 12 is decreasing over time or when the motion sensor 12 detects movement away from the motion sensor 12 in which a distance of the person to the motion sensor is increasing over time, the control unit 16 plays an audible message that is not associated with a detected direction of movement. In the only-toward mode, when the motion sensor 12 detects movement toward the motion sensor 12 in which a distance of the person to the motion sensor 12 is decreasing over time, the control unit 16 plays an audible message associated with movement towards the motion sensor 12.

In the only-away mode, when the motion sensor 12 detects movement away from the motion sensor 12 in which a distance of the person to the motion sensor is increasing over time, the control unit 16 plays an audible message associated with movement away from the motion sensor 12. In the direction-based mode, when the motion sensor 12 detects movement toward the motion sensor 12 in which a distance of the person to the motion sensor 12 is decreasing over time, the control unit 16 plays an audible message associated with movement toward the motion sensor 12 and, when the motion sensor 12 detects movement away from the motion sensor 12 in which a distance of the person to the motion sensor 12 is increasing over time, the control unit 16 plays a different audible message associated with movement away from the motion sensor 12. Other operation modes are contemplated based on the functionalities described herein of the audible alert device 10.

In some embodiments, the audible alert device 10 is configured to allow the user to record and store personalized messages to the control unit 16 via a microphone. Personalized messages can also be recorded through other means, such as with a laptop, tablet, smart phone or other electronic device having recording capability, and digitally transferred to the device 10. For example, the messages may be added to the device 10 memory by connection to and communication through a universal serial bus (USB) port in which data files are transferred to a memory on-board of the device 10. Personalized messages recorded through devices external to the audible alert device 10 can also be received by the control unit 16 through wireless transfer such as WiFi or Bluetooth. In this way, a "generic" device can be sold that is highly configurable and can be used in and adapted for many specific use cases.

In some forms, the audible alert device 10 may also include a light emitting element 22, such as a light emitting diode (LED). The control unit 16 can be programmed so that the light emitting element 22 is illuminated whenever the control unit 16 plays an audible message, or is illuminated only with respect to a corresponding direction-based movement detection by the motion sensor 12, such as movement toward or away from the motion sensor 12.

It is also contemplated that, in some forms, the control unit 16 may also include a delay feature such that the control unit 16 ignores the activating condition for a period of time (e.g., 15 seconds) after an activation event. The delay feature prevents unnecessary repeated activation of the audible alert device 10 by the same person.

Figure 3:
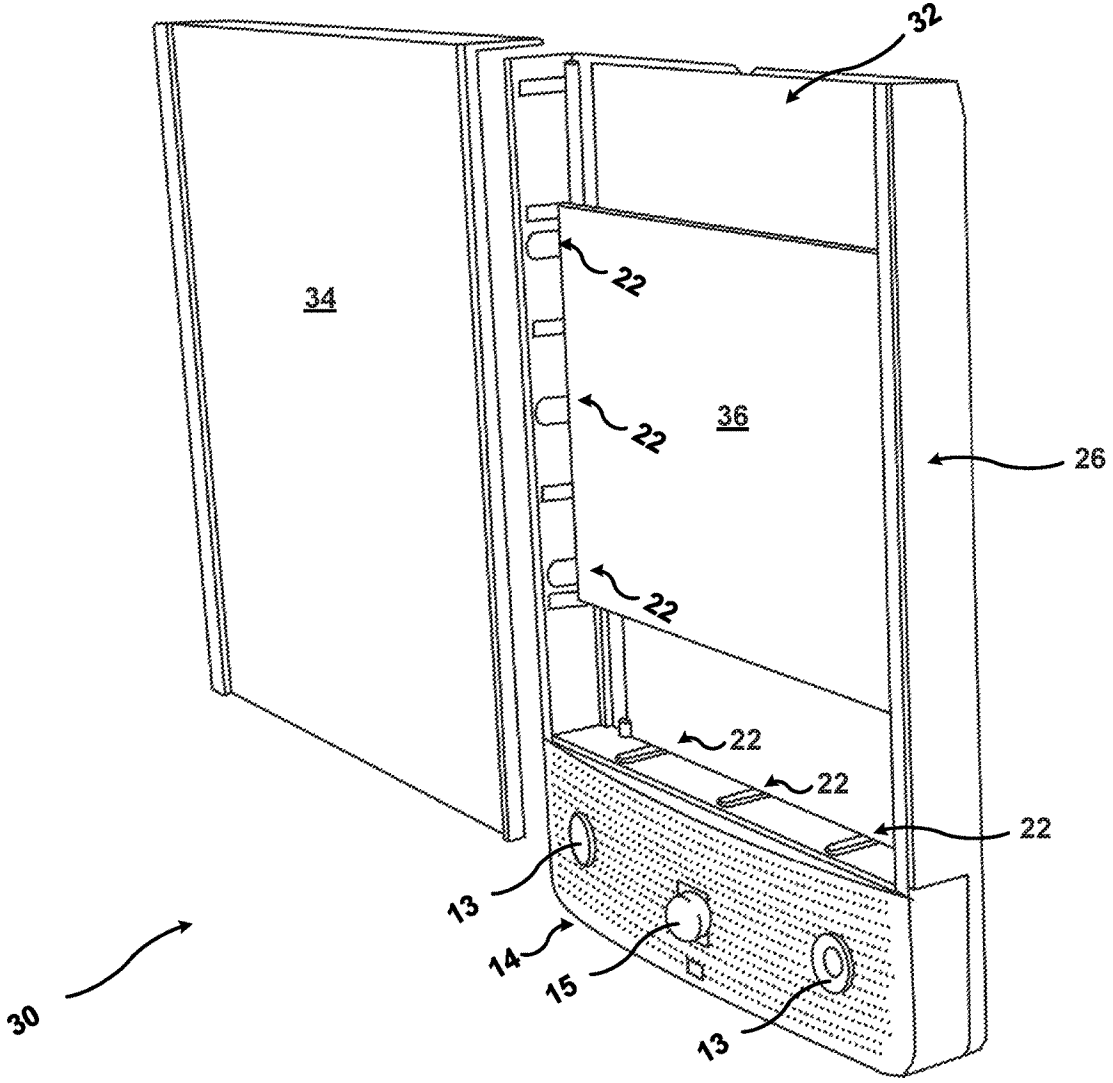
FIG. 3 is a view of an audible alert device configured with an illuminable sign.

In some forms, an audible alert device such as the audible alert device 10 may include a visual display. FIG. 3 depicts an example embodiment 30 with the housing 26 modified to accommodate various features. The embodiment 30 may include the ultra-sonic sensors 13 and infrared sensor 15 along with the speaker 14, within the housing 26. As shown, the embodiment 30 includes a recess 32 in the housing 26 configured to be covered or enclosed by a protective cover 34. The recess 32 may be configured as shown to receive and retain a visual sign 36 as further depicted in FIGS. 4-5. The sign 36 may be illuminated by lighting elements 22 disposed within the recess or any other suitable location and triggered by the control unit 16. The cover 34 may be at least partially transparent to allow viewing of the sign 36 through the cover 34 when the sign 36 is illuminated.

In some forms, the audible alert device 10 may be incorporated into a safety alert system, in which an audible alert device 10 similar to the embodiment described above is included with a visual display 24 that is in close proximity to the audible alert device 10. The visual display 24 can be in communication with the audible alert device 10 to provide a visual image corresponding to the activating condition and/or corresponding to the audible message. The safety alert system may thereby provide visual and auditory signals to more conspicuously draw attention to the content of the visual display 24 or the audible message played by the audible alert device 10. In some forms functions of the audible alert device 10 and the visual display 24 may be combined in a single unit such as the combined alert device 30 of FIG. 3, as shown in FIG. 4.

Figure 4:
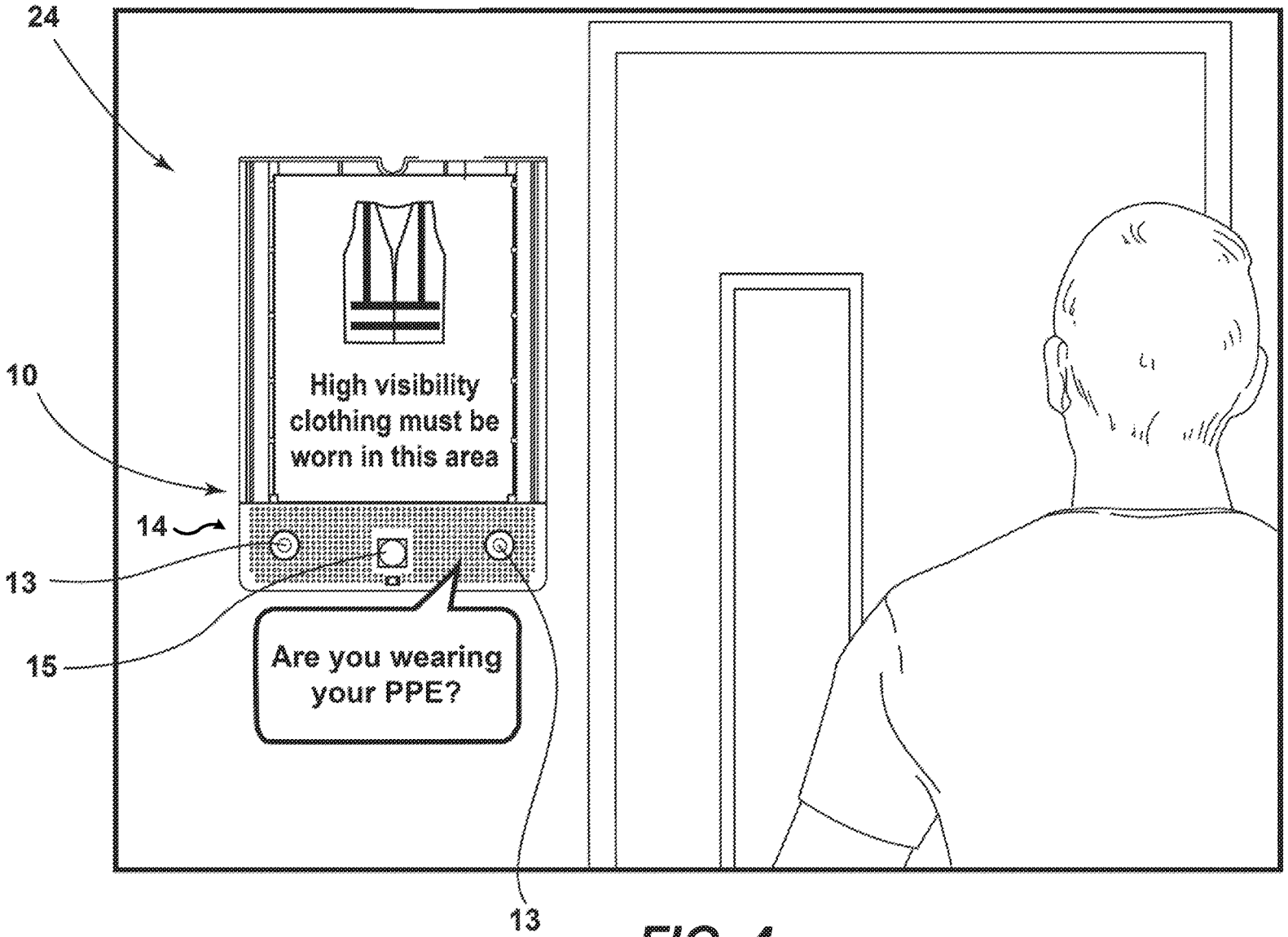
FIG. 4 illustrates a safety alert system in a usage condition.

For example, as shown in FIG. 4, the audible alert device 10 is drawing the attention of a passerby not only to an auditory safety related message, but also to a visual display 24 corresponding to the safety related message.

Figure 5:
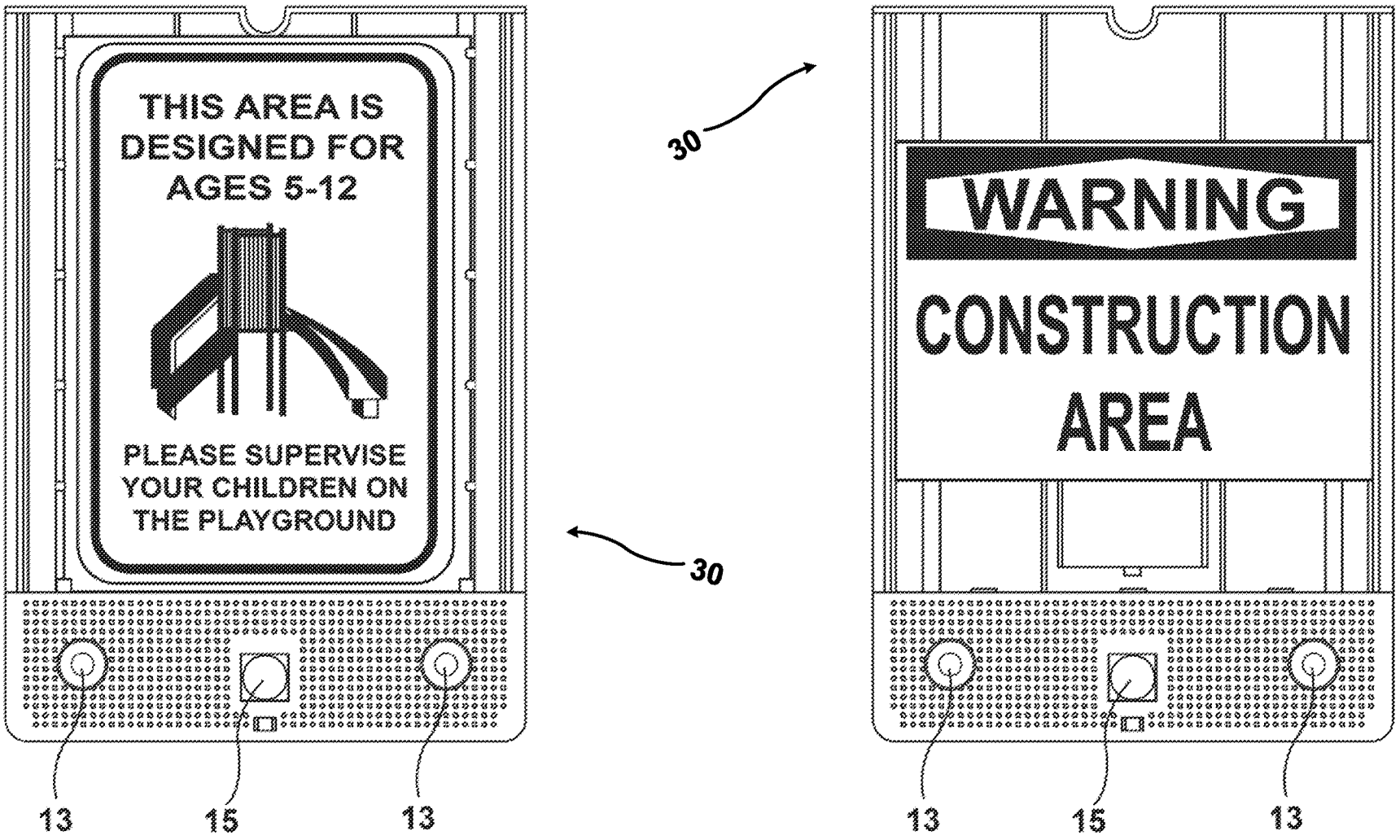
FIG. 5 shows schematic views of the alert device of FIG. 3 with two different example signs installed.

The visual display 24 may be a sign inserted into a holder, such as the sign 32 inserted in embodiment 30 as shown in FIG. 3 or as shown in the examples of FIG. 5.

Figure 6:
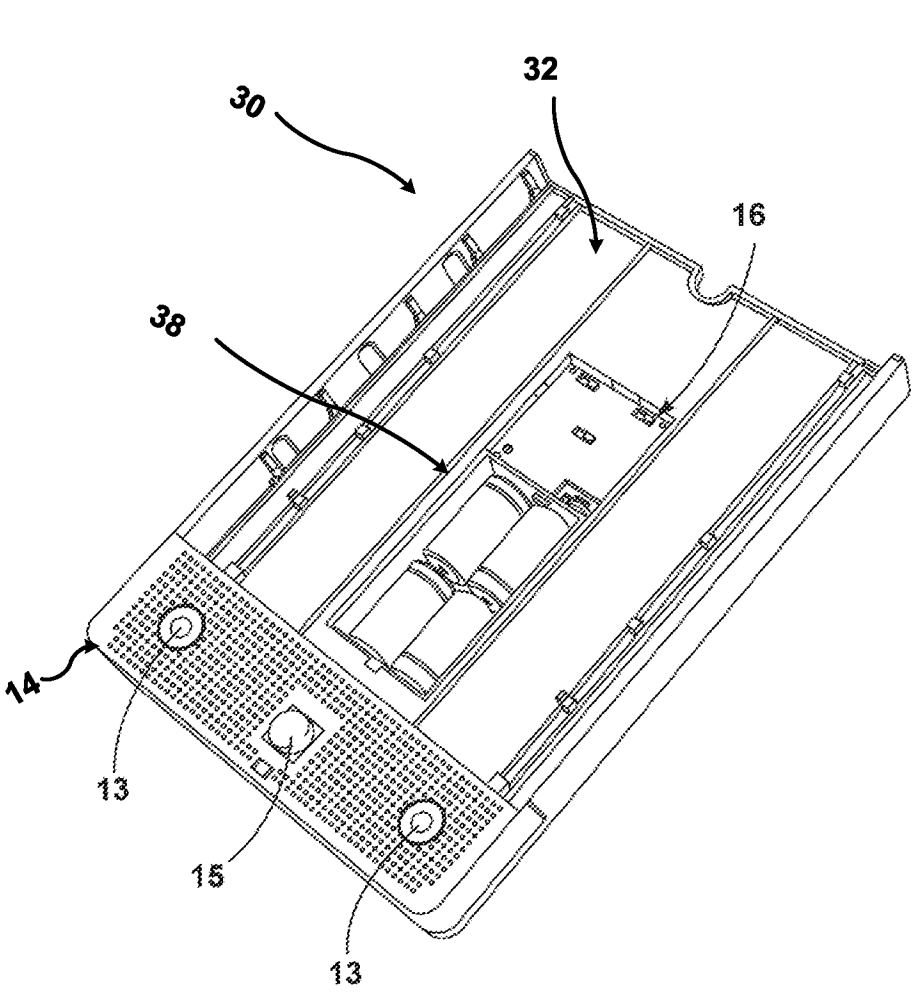
FIG. 6 shows two disassembled views of the alert device of FIG. 3 with the sign removed.
Figure 6:
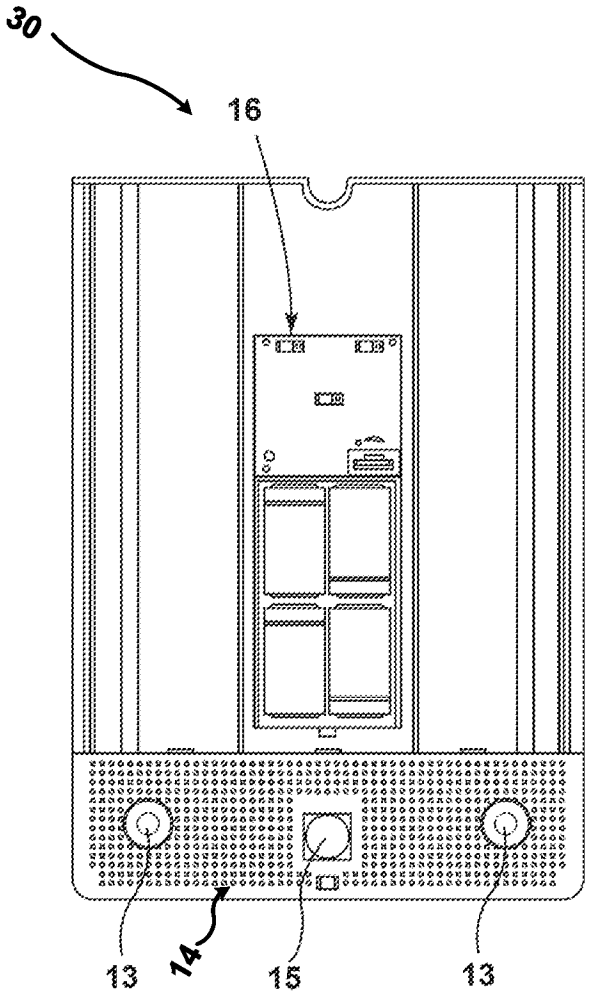

Additional elements of the embodiment 30 and related embodiments may be understood with reference to FIG. 6 which shows two exploded views of the embodiment 30. As shown, a battery compartment 38 (shown with batteries installed) and the control unit 16 are disposed within the housing 26 and accessible via the recess 32. As shown, the control unit 16 provides a control panel which may be used to at least partially configure operation of the control unit 16. Although the embodiment 30 is depicted with batteries installed, the control unit 16 may be powered in any acceptable manner, including, but not limited to receiving AC or DC power from an electric socket or wiring.

Figure 7:
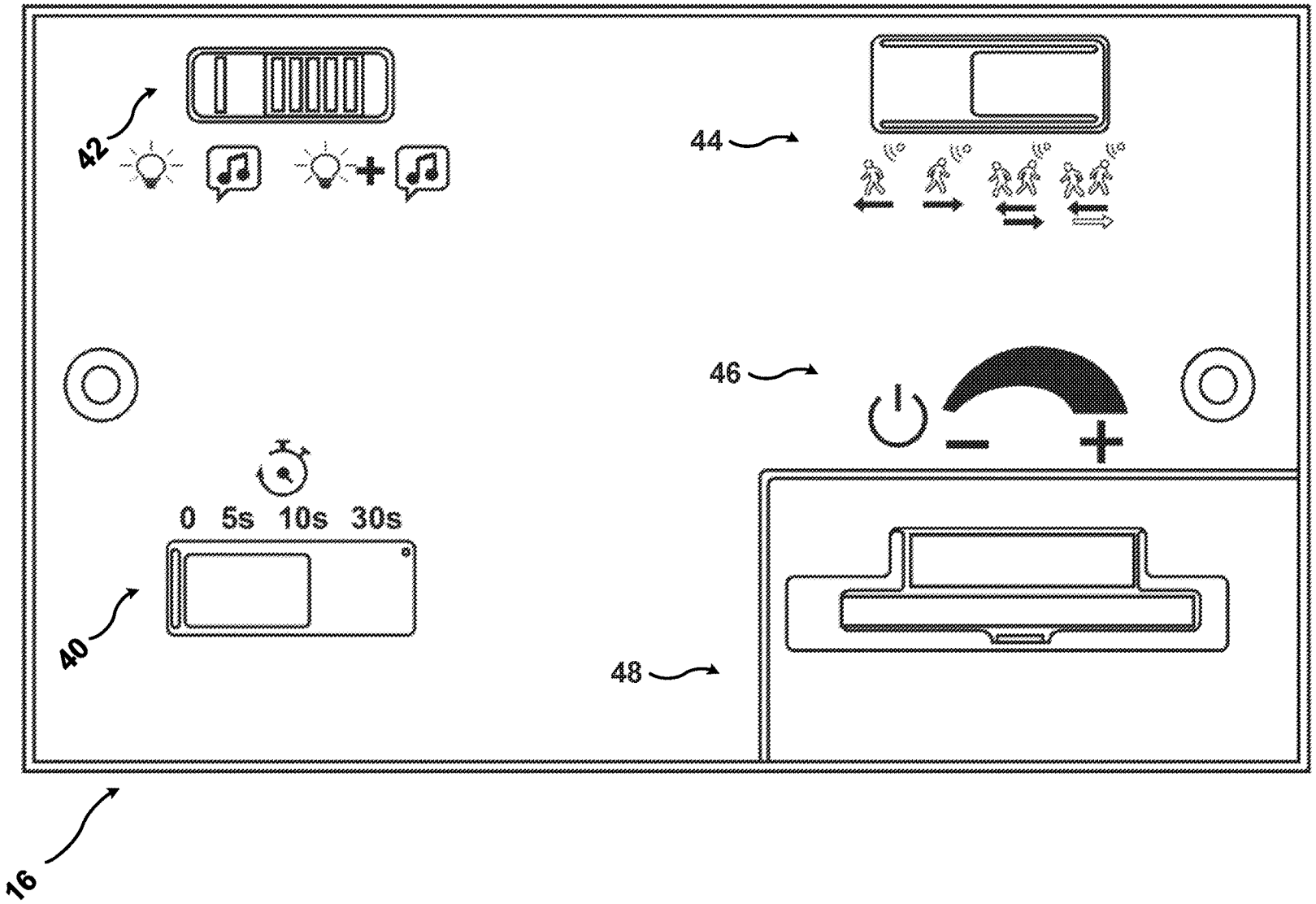
FIG. 7 shows a front panel of an example control unit for use with alert device of FIG. 3 according to certain embodiments.

FIG. 7 depicts an example control panel of the control unit 16 according to some embodiments. As shown, the control unit 16 may include a switch 40 which may be used to select between various delay times (e.g., 0, 5, 10, or 30 seconds) between consecutive alerts. For example, if the switch 40 is set to the "5 s" position, the control unit may prevent an alert from being triggered if it has been less than 5 seconds since the last time the alert was triggered.

As shown, the control unit 16 may include a switch 42 which may be used to select between 3 alert modes; in this example available modes include: visual alerts only (depicted by a lightbulb icon), audible alerts only (depicted by a musical note icon), and combined audible and visible alerts (a lightbulb "plus" a musical note).

As shown, the control unit 16 may include a switch 44 which may be used to select between activation modes indicated by icons representing those modes, e.g., activation when motion approaching the device is detected, activation when motion moving away from the device is detected, activation when motion in either direction is detected (two solid arrows), or activation when motion in either direction is detected but with distinct audible alerts produced depending on the direction (one solid arrow with one arrow in outline).

The control unit 16 may include a pair of buttons or other suitable device which may be used to adjust the volume of audible alerts. As shown, the control unit 16 may include a volume control wheel 48 (along with indications 46 illustrating operation of the volume wheel 48). The volume wheel 48 may be raised to allow a user to rotate the wheel to increase or decrease the volume and also may potentially be used to turn the control unit 16 or its audio on and off. For instance, as shown the volume wheel 48 may be rotated to a starting position to left to power the unit off and rotating to the right from the starting position to first turn the control unit 16 on and then to increase the volume setting with additional rotation to the right.

The control unit 16 may be provided with a memory card slot configured to receive a memory card and/or other interfaces through which it may receive and store information. The control unit 16 may be configured to receive a memory card storing user-supplied alert sounds and/or configuration information used to configure operation of the control unit 16 and/or store diagnostic and other data related to operation of the alert device. The control unit may 16 be configured to receive and/or store information exclusively via a memory card slot, a wired communication interface (which may be a USB interface, as a non-limiting example), or a wireless communication interface, or any of these interfaces in any suitable combination. As a non-limiting example, the control unit 16 may access information from a memory card by default but also allow information received by other means to override the information received via the memory card.

In some embodiments, an alert device is provided comprising a motion sensor, a display module, and a control unit. The display module can be an LED sign, a projector to project a sign or image, a variety of lighting elements in various color arrangements, among others, to draw the visual attention of a person. The alert device functions similarly to the audible alert device described above, except the control unit stores a visual message, and when the activating condition is met, a visual message corresponding to an activating condition that relates to the direction of movement of the person is displayed via the display module.

For example, the alert device described in the preceding paragraph can include an activating condition that is based on the direction toward or away from the motion sensor, a user interface can allow a user to select from a variety of modes in which different visual messages are displayed based on the direction of movement detected by the motion sensor, the control unit can be configured to randomly select the visual message from a plurality of visual messages, and the control unit can be configured to receive personalized visual messages from the user.

It should be understood that, in alert devices having multiple sensors which may be sensitive to motion that the device may use inputs from sensors of different types according to various methods, which may confer various advantages. As one non-limiting example, an alert device may operate in a low-power mode until triggered by motion detected by an infrared-based motion sensor. Upon receiving a triggering signal control circuitry (e.g., the control unit 16) may place the alert device into an active state that includes activation of additional motion sensors (e.g., one or more ultra-sonic, LiDAR, or other sensors) to determine the distance and direction of the detected motion over time in order to perform methods disclosed herein.

It should be understood that although certain configurations of the control unit 16 and other elements are pictured in the Figures and described with reference thereto, that elements of embodiments disclosed herein may be assembled in various ways. For instance, a control unit (e.g., the control unit 16) may communicate wirelessly (or via wires) with one or more of a speaker (e.g., the speaker 14), a motion sensor (e.g., the motion sensor 12 or components thereof such as the infrared sensor 15 and/or ultra-sonic sensors 13), or a display (e.g., the sign 36 with illuminating elements 22). Accordingly, individual elements need not reside within a single housing and may be disposed apart from each other. In such embodiments, individual elements may be powered in any acceptable manner. For instance, each element may be powered by batteries and/or connection to an AC or DC power source.

It should be understood that nothing herein is intended to require embodiments to have a particular form factor and also that embodiments disclosed herein may be configured for temporary or permanent mounting on walls or other surfaces, configured as one or more freestanding devices, or incorporated into other structures in any acceptable manner. In one non-limiting example, an alert device according to embodiments disclosed herein is incorporated into a metal, plastic, concrete, or other barrier. In another non-limiting example, an alert device according to embodiments disclosed herein is incorporated in the body of another object such as a traffic cone or other warning device. Still further, it is contemplated that parts of the device do not need to be part of a single body or housing and may instead be separated into two or more components. For example, a first part of the device could plug into an electrical outlet in a wall and a second part may be mounted elsewhere in the room. In this way, it might be possible to provide preferred positioning of parts or components within a space for the desired type of detection and/or to provide for supplying power to one or more components while permitting other parts of the device to be remotely powered by battery.

Thus, an alert system is provided having unique detection criterion based on directionality of movement. Further to the discussion above, it is contemplated that such criterion may not only include directionality but also time and/or absolute distance considerations (e.g., only activate when a person initially enters a 15-foot radius of the motion sensor and continues to walk toward the sensor for 2 seconds).

While various representative embodiments have been illustrated, many general principles disclosed herein are contemplated as being independently employable as well as in all workable permutations and combinations. Further, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. An audible alert device comprising:

a motion sensor configured to detect directionality of movement of a person relative to the motion sensor;

a speaker;

a control unit in communication with the motion sensor and the speaker, the control unit being configured to:

store an audible message, determine whether an activating condition is met, the activating condition relating to a direction of movement of the person with respect to the motion sensor, and play the audible message corresponding to the activating condition when the activating condition is met;

a user interface in communication with the control unit, the user interface configured to allow a user to select an operation mode from a set of operation modes, wherein the set of operation modes includes two or more of the following operational modes:

(i) an any-direction mode wherein, when the motion sensor detects movement in any direction relative to the motion sensor, the control unit plays an audible message that is not associated with a detected direction of movement, (ii) an only-first direction mode wherein, when the motion sensor detects movement in a first direction relative to the motion sensor, the control unit plays an audible message associated with movement in the first direction, (iii) an only-second direction mode wherein, when the motion sensor detects movement in a second direction relative to the motion sensor, the control unit plays an audible message associated with movement in the second direction, and (iv) a direction-based mode wherein, when the motion sensor detects movement in the first direction, the control unit plays an audible message associated with movement in the first direction and, when the motion sensor detects movement in the second direction, the control unit plays a different audible message associated with movement in the second direction, wherein the first direction is different than the second direction.

2. The audible alert device of claim 1, wherein the motion sensor comprises at least two sensors, including an infrared motion sensor.

3. The audible alert device of claim 2, wherein the motion sensor further comprises at least one of the following sensors:

an ultrasonic sensor;

a LiDAR sensor;

a laser rangefinder a radar sensor; and a camera configured to provide images usable by the control unit to determine presence or motion of the person.

4. The audible alert device of claim 1, wherein the activating condition is the detection of movement toward the motion sensor in which a distance of the person to the motion sensor is decreasing over time.

5. The audible alert device of claim 1, wherein the activating condition is the detection of movement away from the motion sensor in which a distance of the person to the motion sensor is increasing over time.

6. The audible alert device of claim 1, wherein the first direction is movement toward the motion sensor in which a distance of the person to the motion sensor is decreasing over time and the second direction is movement away from the motion sensor in which a distance of the person to the motion sensor is increasing over time.

7. The audible alert device of claim 1, further comprising a light emitting element, wherein the light emitting element is illuminated when the audible alert device plays the audible message.

8. The audible alert device of claim 1, wherein the control unit is further configured to randomly select the audible message to be played from a plurality of audible messages.

9. An audible alert device comprising:

a motion sensor configured to detect directionality of movement of a person relative to the motion sensor;

a speaker;

a control unit in electrical communication with the motion sensor and the speaker, the control unit being configured to:

store an audible message, determine whether an activating condition is met, the activating condition relating to a direction of movement of the person with respect to the motion sensor, and play the audible message corresponding to the activating condition when the activating condition is met;

a user interface in communication with the control unit, wherein the user interface is configured to allow a user to select an operation mode from a set of operation modes, wherein the set of operation modes includes two or more of the following operational modes:

(i) an any-direction mode wherein, when the motion sensor detects movement toward the motion sensor in which a distance of a person to the motion sensor is decreasing over time or away from the motion sensor in which a distance of the person to the motion sensor is increasing over time, the control unit plays an audible message that is not associated with a detected direction of movement, (ii) an only-toward mode wherein, when the motion sensor detects movement toward the motion sensor in which the distance of the person to the motion sensor is decreasing over time, the control unit plays an audible message associated with movement toward the motion sensor, (iii) an only-away mode wherein, when the motion sensor detects movement away from the motion sensor in which the distance of the person to the motion sensor is increasing over time, the control unit plays an audible message associated with movement away from the motion sensor, and (iv) a direction-based mode wherein, when the motion sensor detects movement toward the motion sensor in which the distance of the person to the motion sensor is decreasing over time, the control unit plays an audible message associated with movement toward the motion sensor and, when the motion sensor detects movement away from the motion sensor in which a distance of the person to the motion sensor is increasing over time, the control unit plays a different audible message associated with movement away from the motion sensor.

10. A safety alert system comprising:

the audible alert device of claim 1;

and an illuminable visual display in close proximity to the audible alert device corresponding to the audible message, the visual display configured to be illuminated when the audible message is played.

11. The system of claim 10 wherein the illuminable visual display comprises a sign and an illuminating device configured to illuminate the sign when the audible message is played.

12. The system of claim 10 wherein the control unit is configurable by a user to:

operate in a display-only mode wherein the control unit is configured to illuminate the visual display and not play the audible message when the activating condition is met; and operate in an audio-only mode wherein the control unit is configured to play the audible message and not illuminate the visual display when the activating condition is met.

13. An alert device comprising:

a motion sensor configured to detect directionality of movement of a person relative to the motion sensor;

a display module;

a control unit in communication with the motion sensor and the display module, the control unit being configured to:

store a visual message, determine whether an activating condition is met, the activating condition relating to a direction of movement of the person with respect to the motion sensor, and display the visual message corresponding to the activating condition when the activating condition is met;

a user interface in communication with the control unit, the user interface configured to allow a user to select an operation mode from a set of operation modes, wherein the set of operation modes includes two or more of the following operational modes:

(i) an any-direction mode wherein, when the motion sensor detects movement in any direction relative to the motion sensor, the control unit displays a visual message that is not associated with a detected direction of movement, (ii) an only-first direction mode wherein, when the motion sensor detects movement in a first direction relative to the motion sensor, the control unit displays a visual message associated with movement in the first direction, (iii) an only-second direction mode wherein, when the motion sensor detects movement in a second direction relative to the motion sensor, the control unit displays a visual message associated with movement in the second direction, and (iv) a direction-based mode wherein, when the motion sensor detects movement in the first direction, the control unit displays a visual message associated with movement in the first direction and, when the motion sensor detects movement in the second direction, the control unit displays a different visual message associated with movement in the second direction, wherein the first direction is different than the second direction.

14. A method of playing an audible message, the method comprising:

detecting a direction of movement of a person with a motion sensor of an audible alert device relative to the motion sensor, the audible alert device further comprising (a) a speaker and (b) a control unit that is in communication with the motion sensor and the speaker, and (c) a user interface in communication with the control unit, the user interface configured to allow a user to select an operation mode from a set of operation modes;

implementing an operation mode from the set of operation modes based on a user selection, the set of operation modes including two or more of the following operational modes:

(i) an any-direction mode wherein, when the motion sensor detects movement in any direction relative to the motion sensor, the control unit plays an audible message that is not associated with a detected direction of movement, (ii) an only-first direction mode wherein, when the motion sensor detects movement in a first direction relative to the motion sensor, the control unit plays an audible message associated with movement in the first direction, (iii) an only-second direction mode wherein, when the motion sensor detects movement in a second direction relative to the motion sensor, the control unit plays an audible message associated with movement in the second direction, and (iv) a direction-based mode wherein, when the motion sensor detects movement in the first direction, the control unit plays an audible message associated with movement in the first direction and, when the motion sensor detects movement in the second direction, the control unit plays a different audible message associated with movement in the second direction, determining whether an activating condition has been met based on the direction of movement of the person detected by the motion sensor;

playing an audible message corresponding to the activating condition when the activating condition is met;

wherein the first direction is different than the second direction.

15. The method of claim 14, wherein the first direction is movement toward the motion sensor in which a distance of the person to the motion sensor is decreasing over time; and the second direction is movement away from the motion sensor in which a distance of the person to the motion sensor is increasing over time.

16. The method of claim 14, further comprising receiving an audible message recorded by a user.

17. The method of claim 14, wherein the motion sensor comprises at least two sensors, including an infrared motion sensor.

18. The method of claim 14, wherein the activating condition is the detection of movement toward the motion sensor in which a distance of the person to the motion sensor is decreasing over time.

19. The method of claim 14, further comprising randomly selecting the audible message corresponding to the activating condition.

20. The method of claim 14, wherein the audible alert device includes a light emitting element and wherein the method further comprises illuminating the light emitting element when the audible alert device plays the audible message.

21. The method of claim 14, further comprising ignoring the activating condition for a set period of time after the activating condition is met and the audible message has been played.

* * * * *